US005261662A

United States Patent [19]

Prevost

[11] Patent Number: 5,261,662

[45] Date of Patent: Nov. 16, 1993

[54] HANDLE FOR AN ICE HOCKEY STICK

[76] Inventor: Lawrence E. Prevost, 1562 Lawrence Dr., Huntingdon, Quebec, J0S 1H0, Canada

[21] Appl. No.: 714,520

[22] Filed: Jun. 13, 1991

[51] Int. Cl.[5] ..... A63B 59/12

[52] U.S. Cl. ..... 273/67 A

[58] Field of Search ..... 273/67.11, 735

[56] References Cited

U.S. PATENT DOCUMENTS

| | | | |
|---|---|---|---|
| 2,569,395 | 9/1951 | Zupanick | 273/67 A |
| 3,533,623 | 10/1970 | Dumont | 273/67 A |
| 4,353,549 | 10/1982 | Goupil | 273/67 A |
| 4,968,032 | 11/1990 | Redekop | 273/67 A |

FOREIGN PATENT DOCUMENTS

| | | | |
|---|---|---|---|
| 455116 | 3/1949 | Canada | 273/67 A |
| 1150331 | 7/1983 | Canada | 273/67 A |
| 2093556 | 9/1982 | United Kingdom | 273/67 A |

*Primary Examiner*—Mark S. Graham

*Attorney, Agent, or Firm*—Christie, Parker & Hale

[57] ABSTRACT

There is provided a new and useful handle for an ice hockey stick, the handle having an upper end and a lower end, the lower end for joining to an ice hockey blade, the handle comprising an elongated central core section of rectangular cross section having top, bottom and first and second sides, the core from the upper end extending a major part of the distance to the lower end and comprising a wood of relatively low density; a shorter blade receiving section of similar cross section to the elongated core section joined to an end of the core section to form a joint, and extending to the lower end of the handle for receiving a slot for a hockey stick blade, the shorter section comprising a wood of relatively higher density; and hardwood veneer strips extending along and secured to each of the first and second sides of the central core sections and overlapping the joint.

16 Claims, 2 Drawing Sheets

HANDLE FOR AN ICE HOCKEY STICK

FIELD OF THE INVENTION

This application relates to handles for ice hockey sticks.

BACKGROUND OF THE INVENTION

Ice hockey sticks have been developing for decades as various attempts have been made to reconcile certain requirements of the ice hockey player with the requirement for added strength.

A player requires a stick which is light and well balanced and with proper flexibility. The stick must have the proper "feel" to the player.

For many years ash was the preferred wood for hockey stick construction. Ash met a number of the required criteria.

Over the years problems have arisen in the availability of supply and cost of ash. Furthermore, while a strong wood, ash is nonetheless subject to breakage due to the extremely high stresses placed on hockey sticks by hockey players.

Over the years many attempts have been made to modify hockey sticks to alleviate the breakage problem while still meeting the remaining criteria. Wide use has been made, for example, of fiberglass strips and hardwood veneers for this purpose.

While the various developments have led to notable improvements in hockey sticks over the years, the breakage problem is still substantial.

It is against this background that the present invention arises.

PRIOR ART

The following patents illustrate attempts over the years to develop improved hockey sticks:

Canadian Patent 345,455, issued Oct. 23, 1934, Evernden.

Canadian Patent 473,239, issued May 1, 1951, to Yerger.

Canadian Patent 906,020, issued Jul. 25, 1972, to Michaud.

Canadian Patent 1,057,788, issued Jul. 3, 1979, to Michaud.

Canadian Patent 1,058,240, issued Jul. 10, 1979, to Tiitola.

Canadian Patent 1,072,142, issued Feb. 19, 1980, to Diederich.

Canadian Patent 1,074,824, issued Apr. 1, 1980, to Diederich.

Canadian Patent 1,150,331, issued Jul. 19, 1983, to Koabel.

Canadian Patent 1,159,092, issued Dec. 20, 1983, to Goupil, et al.

Canadian Patent 1,180,728, issued Jan. 8, 1985, to Michaud.

U.S. Pat. No. 4,968,032, issued Nov. 6, 1990, to Redekop.

SUMMARY OF THE INVENTION

It has now been discovered that a hockey stick having improved strength characteristics can be constructed in which the majority of the handle comprises a relatively less dense wood but in which that area of the handle which will ultimately be slotted to receive a hockey stick blade in a tenon joint is of a relatively more dense wood, such as the traditional ash.

Thus, the invention provides a handle for an ice hockey stick, the handle having an upper end and a lower end, the lower end for joining to an ice hockey blade, the handle comprising an elongated central core section of rectangular cross section having top, bottom and first and second sides, the core extending from the upper end a major part of the distance to the lower end and comprising a wood of relatively low density; a shorter blade receiving section of similar cross section to the elongated core section joined to an end of the core section to form a joint, and extending to the lower end of the handle for having a slot formed therein a hockey stick blade, the shorter section comprising a wood of relatively higher density; and hardwood veneer strips extending along and secured to each of the first and second sides of the central core sections and overlapping the joint.

In a further embodiment there is provided a handle for an ice hockey stick, the handle having an upper end and a lower end, the lower end for joining to an ice hockey blade, the handle comprising an elongated central core section of rectangular cross section having top, bottom and first and second sides, the core extending from the upper end a major part of the distance toward the lower end and being comprised of a wood of relatively low density; a shorter blade receiving section of rectangular cross section joined flush to the lower end of the core and extending to the lower end of the handle, the blade receiving section comprised of a wood of relatively higher density; a fiberglass reinforcing strip secured along at least a part of each of the first and second sides and overlying the line of joining of the core to the blade receiving structure; and a strip of hardwood veneer secured along each fiberglass strip; and wherein a lower section of the handle comprising the core and the blade receiving section is tapered from a point a short distance above the line of joining, to the lower end of the handle; the handle further comprising a pair of wedge shaped members secured to the opposite sides of the tapered section, the outer surface of the members flush with an untapered part of the handle.

BRIEF DESCRIPTION OF THE DRAWINGS

In drawings which illustrate embodiments of the invention.

Figure 1:
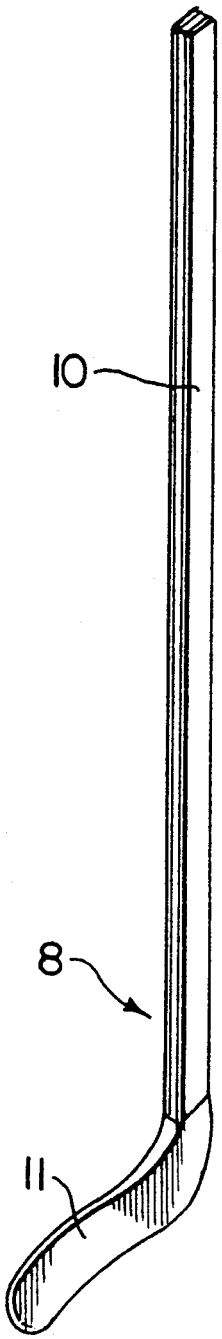
FIG. 1 illustrates a typical ice hockey stick.

While the invention will be described in conjunction with illustrated embodiments, it will be understood that it is not intended to limit the invention to such embodiments. On the contrary, it is intended to cover alternatives, modifications and equivalents as may be included within the spirit and scope of the invention as defined by the appended claims.

DETAILED DESCRIPTION OF THE PREFERRED EMBODIMENTS

In the following description, similar features in the drawings have been given similar reference numerals.

Since one of the most frequent areas of breakage of hockey sticks is in the area of the tenon joint between the hockey stick blade and the handle, particular attention must be paid to this area. A construction has now been devised which utilizes a stronger more dense hardwood as the blade receiving part of the handle. The hardwood is joined to a conventional less dense core section of the handle. The joint between the two wood types is overlapped by reinforcing material.

In the preferred configuration the less dense and more dense parts of the handle are comprised of a number of laminations, and the joint between those sections is comprised of overlapping wedged ends of the respective laminations.

FIG. 1 illustrates a typical ice hockey stick 8 comprising a handle 10 and a blade 11. Typically the handle and blade portions are constructed separately and then joined in an assembly step. The present invention relates only to the construction of the handle 10 which is manufacture as a completely separate unit from the hockey stick blade 11 and is only later, at a stage which has nothing to do with the present invention, joined to a blade 11.

Figure 2:
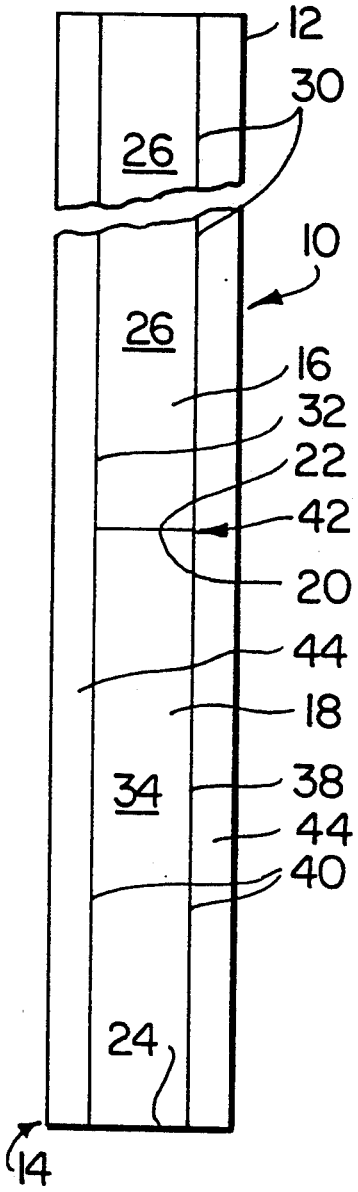
FIG. 2 illustrates a hockey stick handle according to the invention.

With reference to the embodiment of FIG. 2, a section of a hockey stick handle 10 of predetermined length is illustrated having an upper end 12 and a lower end 114. The handle 10 comprises an elongated upper central core section 16, a blade receiving or lower core section 18 and reinforcing strips 44. The lower core section of handle 10 will be joined at a later stage of manufacture to a hockey stick blade 11 at a first joint which is formed at the end 24 of the lower core 18. The end 24 of lower core 18 may thus be considered to be a joint coupling means.

The elongated central core section 16 extends from upper end 12 of the handle to a point spaced from lower end 14.

The blade receiving section 18 has an upper end 20 joined to a lower end 22 of central core 16 at a second joint designated generally as 42. The lower end 24 of blade receiving section 18 terminates at the lower end 14 of handle 10. The second joint 42 is spaced from the lower end 24 of lower core 18.

The central core section 16 and the blade receiving section 18 are both of substantially rectangular cross section. Thus, core section 16 has top surface 26, bottom surface 28 and first and second side surface 30 and 32. The blade receiving section 18 has corresponding top surface 34, bottom surface 36 and first and second side surfaces 38 and 40. The top and bottom surfaces correspond to the shorter sides of the rectangular cross section. The side surfaces correspond to the longer sides of the rectangular cross section. The length of the upper core section, plus the length of the lower core section when joined together, correspond to the predetermined length.

At the joint 42 the top surface, bottom surface and side surface of blade receiving section 18 are flush with corresponding ones of core section 16.

At least one of reinforcing strips 44 is secured to each of first and second side surface 30 and 32 and 38 and 40 respectively of core section 16 and blade receiving section 18, and overlaps joint 42. The reinforcing strips 44 preferably extend from upper end 12 to lower end 14 of handle 10.

Strips 44 are preferably of a hardwood veneer, preferably 10-ply birch.

Figure 3:
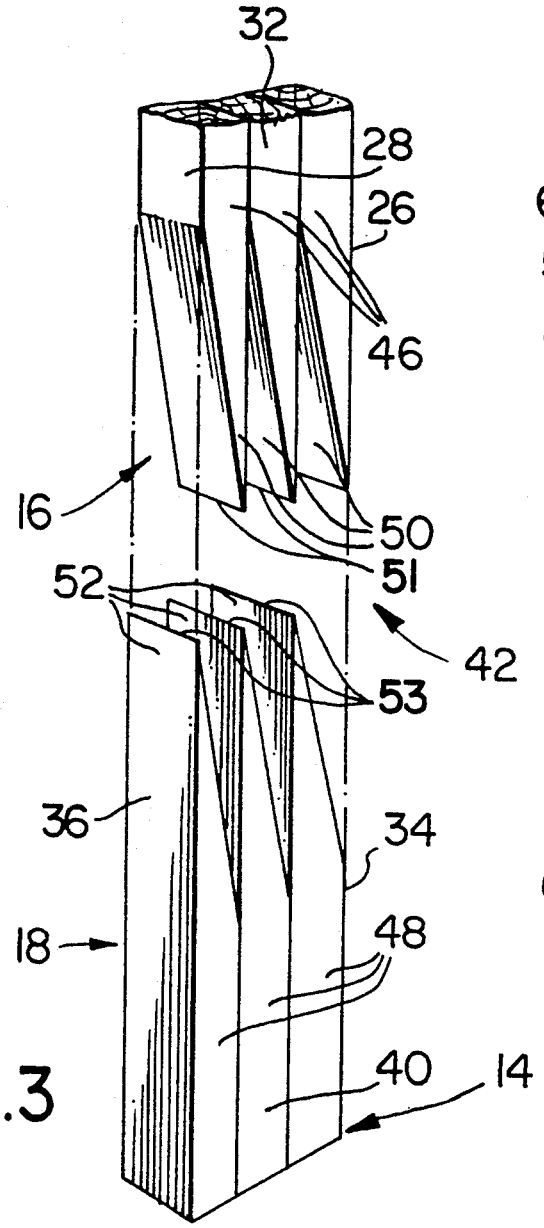
FIG. 3 is an exploded view of a joint for joining parts of a hockey stick handle according to the invention.

Detail of the preferred configuration of the joint 42 is illustrated in FIG. 3. The core section 16 and blade receiving section 18 are preferably comprised of at least two and preferably three laminations 46 and 48 respectively. The laminations 46 and 48 are formed at their ends into fingers which are preferably wedge-shaped sections 50 and 52 respectively. The taper of the wedge shapes 50 and 52 is upwardly or downwardly in terms of the top and bottom surfaces 26 and 28 of core sections 16, and 34 and 36 of blade receiving section 18.

The wedge-shaped ends 50 of core section 16 are then interfitted with the corresponding wedges 52 of blade receiving section 18. Leading edges 51 and 53 respectively of the tapered wedge-shaped parts 50 and 52 extend parallel to a shorter side of a cross section of the handle. The lines defining the leading edges are thus perpendicular to side surfaces 30 and 32, and 38 and 40.

The laminations of core section 16 and blade receiving section 18 and the overlapping wedges are all secured in place by conventional gluing.

Figure 4:
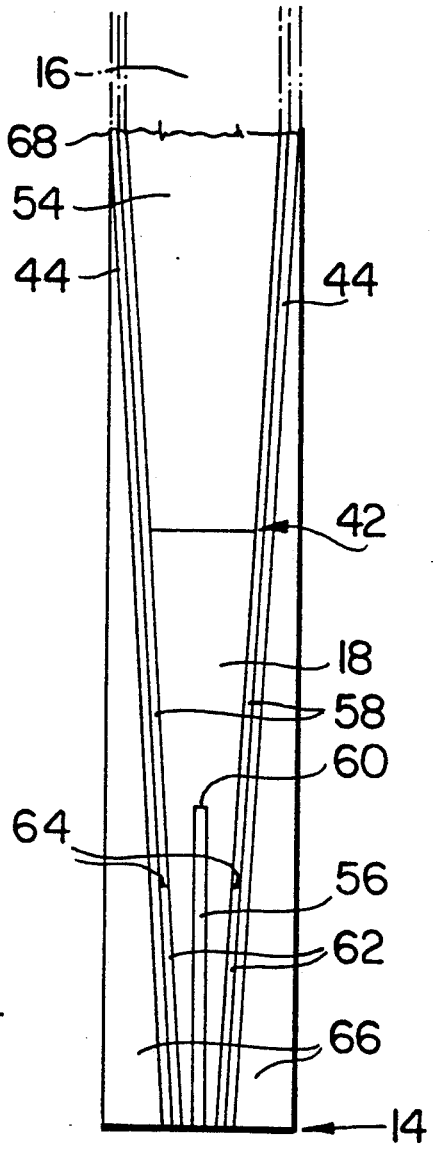
FIG. 4 is a top view of a part of a hockey stick handle illustrating a further embodiment of the invention.

A further embodiment of the invention is illustrated in FIG. 4. In this embodiment the lower part 54 of core section 16 is tapered to the joint 42. The blade receiving section 18 then continues the taper to the lower end 14 of handle 10. The detail of joint 42 in this embodiment is identical to that described above in the discussion of FIG. 3.

In this embodiment an additional reinforcing strip 58 of fiberglass is arranged to overlap joint 42 and a part of groove 56. The groove 56 is for purposes of illustration only and is not normally formed in the handle by the handle manufacturer. The groove 56 is inserted by the stick maker to receive a corresponding tongue formed on the blade. As indicated above, the present invention relates to the structure of the handle per se. The insertion of groove 56 and the fixing of the blade to the handle is not a part of the present invention. Thus, as indicated above, the end 24 of blade receiving section 18 may be considered to be a joint coupling means, since it receives a groove 56 for coupling with a tongue of a hockey stick blade.

In the preferred configuration and as an aid in finishing processes, the fiberglass strip 58 extends some distance beyond the upper end 60 of groove 56 toward lower end 14 of handle 10 but terminates short of lower end 14. Otherwise the fiberglass strip 58 preferably extends over the first and second side surfaces of core section 16 and blade receiving section 18 from a position at or near upper end 12 of handle 10.

In the most preferred configuration a short hardwood veneer strip 62 is interposed between the end 64 of fiberglass strip 58 and the lower end 14 of handle 10.

The reinforcing strips 44 are maintained in this embodiment, but are preferably comprised of a single ply of birch veneer.

A pair of wedge-shaped members 66 are secured to the tapered section of handle 10 to maintain the essentially constant rectangular cross section of the handle. Members 66 are flush with the first and second side surfaces 30 and 32 of core section 16 at the line 68 at the beginning of the tapered section of core 16.

The joint 42 of FIG. 4 preferably includes the same laminated structure with overlapping wedge sections at the joint 42 as was described in respect of FIG. 3.

The preferred lower density wood for central core section 16 is aspen, but other suitable types are spruce, basswood and poplar.

Similarly, the preferred higher density hardwood for the blade receiving section 18 is ash, but other wood such as birch, maple and hickory would also be acceptable.

In a typical construction the blade receiving section 18 will be about six inches in length from the end 14 of handle 10 to the line at which the tapered wedges of the joint 4 begin. The tapered wedges will themselves be about six inches in length. In the tapered embodiment of FIG. 3 the blade receiving section 18 will narrow to a width of about one-quarter inch at the end 14 of handle 10. The reinforcing veneer strip 44 is in the 10-ply birch veneer case of FIG. 2 about two-hundred thousandths of an inch in thickness. The fiberglass reinforcing strips may be typically thirty-eight thousandths in thickness and the short veneer filler strips 62 will then of course be of the same thickness.

The wedge-shaped members 66 are preferably of the same high density hardwood as blade receiving section 18.

Thus it is apparent that there has been provided in accordance with the invention a handle for an ice hockey stick that fully satisfies the objects, aims and advantages set forth above. While the invention has been described in conjunction with a specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. A handle for an ice hockey stick, said handle having a predetermined length, an upper end, and a lower end, said lower end comprising joint coupling means for joining to an ice hockey stick blade by means of a first joint, said handle comprising:

an elongated upper central core section of rectangular cross section having a top surface, a bottom surface, and first and second side surfaces, said upper core extending from said upper end of said handle a major part of the distance of said lower end of said handle and comprising a wood of relatively low density;

a shorter blade receiving lower central core section of similar cross section to said elongated upper core section also having a top surface, bottom surface, and first and second side surfaces and joined to an end of said upper core section to form a second joint; said lower core section extending to said lower end of said handle and adapted for having a slot formed therein for joining to a hockey stick blade to form the first joint, said lower central core section comprising a wood of relatively high density; and hardwood veneer strips extending along and secured to each of said first and second side surfaces of said upper and lower central core sections and overlapping said second joint, wherein the second joint is spaced from the lower end and the first joint, and the lower core section terminates at the first joint, and wherein a length of the upper core section plus a length of the lower core section when joined together corresponds to the predetermined length.

2. The handle of claim 1 comprising, in addition, a fiberglass reinforcing strip interposed between said veneer strips and said side surfaces of said upper and lower core sections.

3. The handle of claim 1 wherein said upper core section and said blade receiving section are comprised of at least two laminations from top to bottom and wherein said laminations have parts tapered second at said joint and are interfitted such that said tapered parts of said laminations of said upper core section overlap with said tapered parts of corresponding ones of said laminations of said blade receiving section.

4. The handle of claim 3 wherein said tapered parts are wedge shaped and tapered on one side only.

5. The handle of claim 4 wherein said tapered parts are tapered in the upward or downward directions between said top surface and said bottom surface.

6. The handle of claim 1 wherein said upper core section is tapered, said taper beginning a short distance above said second joint and continuing to said second joint, and continuing further along the length of said blade receiving section, said taper comprising a progressive decreasing of the distance between said first and second side surfaces.

7. The handle of claim 6 comprising, in addition, a fiberglas reinforcing strip interposed between each said veneer strip and said sides, each said fiberglass strip terminating short of said lower end of said blade receiving section; and an additional short veneer strip from a lower end of each said fiberglas strip to said lower end of said handle and flush with said fiberglas strips.

8. The handle of claim 7 comprising a pair of wedge-shaped members secured over said tapered section such that the outermost surfaces of said wedge-shaped members are flush with the first and second side surfaces of the untapered part of said handle.

9. The handle of claim 6 wherein said upper core section and said blade receiving section are comprised of at least two laminations between said top surface and said bottom surface and wherein said laminations have a wedge-shaped taper at said second joint and are interfitted such that said wedge-shaped taper of each lamination of said upper core section overlaps a wedge-shaped taper of a corresponding lamination of said blade receiving section; and wherein the leading edges of said tapers are oriented perpendicular to said first and second side surfaces of said upper core section and said blade receiving section.

10. The handle of claim 1 wherein said wood of relatively low density is aspen.

11. The handle of claim 1 wherein the wood of relatively high density is ash.

12. The handle of claim 1 wherein said veneer strips are 10 ply birch.

13. The handle of claim 1 wherein the distance from said lower end of said handle to said second joint is 6 inches.

14. The handle of claim 6 wherein the thickness of said lower core section at said lower end of said handle is 0.25 inch.

15. The handle of claim 1, wherein the hardwood veneer strips extend for the predetermined length along the first and second sides of the upper central core section and along first and second sides of the lower core section, the lower core section being distinct from the hardwood veneer strips.

16. The handle of claim 3, wherein edges of the tapered portions extend parallel to a shorter side of a cross section of the handle.

* * * * *